US008608500B2

(12) United States Patent
Nowotnick et al.

(10) Patent No.: US 8,608,500 B2
(45) Date of Patent: Dec. 17, 2013

(54) PLUG CONNECTION DEVICE

(75) Inventors: Jens Nowotnick, Reutlingen (DE); Oliver Gradtke, Reutlingen (DE); Matthias Lausmann, Murr, DE (US)

(73) Assignee: Robert Bosch GmbH, Stuttgart (DE)

( * ) Notice: Subject to any disclaimer, the term of this patent is extended or adjusted under 35 U.S.C. 154(b) by 152 days.

(21) Appl. No.: 13/259,234

(22) PCT Filed: Mar. 19, 2010

(86) PCT No.: PCT/EP2010/053587
§ 371 (c)(1),
(2), (4) Date: Sep. 23, 2011

(87) PCT Pub. No.: WO2010/115693
PCT Pub. Date: Oct. 14, 2010

(65) Prior Publication Data

US 2012/0015557 A1 Jan. 19, 2012

(30) Foreign Application Priority Data

Apr. 7, 2009 (DE) ..... 10 2009 002 242

(51) Int. Cl.
*H01R 4/48* (2006.01)

(52) U.S. Cl.
USPC ..... 439/267; 439/260

(58) Field of Classification Search
USPC ..... 439/76.1, 620.21
See application file for complete search history.

(56) References Cited

U.S. PATENT DOCUMENTS

| | | | | |
|---|---|---|---|---|
| 5,712,766 | A * | 1/1998 | Feldman | 361/737 |
| 6,979,216 | B2 * | 12/2005 | Maeda et al. | 439/260 |
| 7,270,557 | B1 | 9/2007 | Yu | |
| 7,766,681 | B1 * | 8/2010 | Wang | 439/276 |
| 7,819,684 | B2 * | 10/2010 | Fumikura | 439/326 |
| 8,110,751 | B2 * | 2/2012 | Kim et al. | 174/261 |
| 8,337,250 | B1 * | 12/2012 | Yang | 439/620.22 |
| 2002/0028598 | A1 * | 3/2002 | Bolliger | 439/425 |
| 2004/0253849 | A1 | 12/2004 | Kuribayashi et al. | |
| 2006/0035492 | A1 | 2/2006 | Sekido | |
| 2007/0082538 | A1 | 4/2007 | Hegner et al. | |
| 2008/0305680 | A1 | 12/2008 | Little et al. | |

FOREIGN PATENT DOCUMENTS

DE 3925648 2/1991

OTHER PUBLICATIONS

PCT/EP2010/053587 International Search Report.

* cited by examiner

*Primary Examiner* — Briggitte R Hammond
(74) *Attorney, Agent, or Firm* — Michael Best & Friedrich LLP

(57) ABSTRACT

The invention relates to a plug connection device, comprising a plug (7) which has contacts (8) and comprising mating contacts (4) arranged on a substrate (2), wherein the contacts (8) are intended for electrical contacting of the mating contacts (4). According to the invention, the plug (7) has at least one recess (18) for accommodating an element (10) arranged on the substrate (2).

14 Claims, 8 Drawing Sheets

PLUG CONNECTION DEVICE

BACKGROUND OF THE INVENTION

The invention relates to a plug connection device comprising a plug which has contacts, and comprising mating contacts arranged on a substrate, wherein the contacts are provided for making electrical contact with the mating contacts.

Plug connection devices of the kind mentioned in the introduction are disclosed in the prior art. They are used for making electrical contact with printed circuit boards, for example, in particular in the form of a direct plug connection. By way of example, a printed circuit board comprising a substrate which has at least two different electronic assemblies is described in DE 39 25 648 A1. These are connected by means of conductors to contacts of a connector strip arranged on a perimeter of the printed circuit board. This connector strip is used to receive a plug. In this case, the plug contains the contacts and the connector strip contains the mating contacts. A single cable or a cable loom can be connected to the plug, for example. The cable or the cable loom respectively is electrically connected to the contacts, so that the electrical connection between printed circuit board and cable or cable loom respectively is made when the plug is plugged into the connector strip. On the other hand, with direct plug connection, it is provided that the plug is plugged onto the substrate, with the mating contacts being arranged immediately on the substrate.

It is frequently desirable to be able to arrange as many elements as possible on the substrate in order to achieve the greatest possible functional density. However, space on the substrate is restricted due to the connector strip and the plug.

SUMMARY OF THE INVENTION

In contrast, the plug connection device has the advantage that the space available on the substrate for elements is increased. This is achieved by the plug having at least one recess for accommodating an element arranged on the substrate. The plug connection device is designed in particular as a direct plugging device. This means that the mating contacts are arranged immediately on the substrate and are contacted by means of the contacts of the plug for making electrical contact. Here, the term plug is understood to mean a pluggable element and therefore not the "male" part of a plug connector in general. The plug can therefore at least partially overlap the substrate in order to make electrical contact. The mating contacts can be arranged on one or both sides of the substrate. In addition or alternatively, they can be provided in a single or multi-row arrangement. The mating contacts are electrically connected to printed circuit tracks, for example, which run on and/or in the substrate. They are preferably provided in a perimeter region of the substrate. According to the invention, the plug must have at least one recess in order to accommodate the element arranged on the substrate. In this way, elements can also be provided in the region of the substrate in which the plug is usually arranged in order to make electrical contact. The element can be accommodated, particularly on the substrate, during and/or after the plug is fitted (that is to say, in a plugged position of the plug). The recess is designed in the form of a (blind) hole or (blind) slot for example. This means that the recess can pass completely through the plug or merely be designed as a cavity therein. In principle, however, the recess can take any form as long as it is suitable for accommodating the element. Because of this design of the plug, the element can be arranged in close proximity to the mating contacts. This is advantageous, as in this way the electrical signal path from the mating contact to the element can be chosen to be very short. By the same token, the area available on the substrate for elements is considerably increased. This is particularly the case, as the element can also be arranged between mating contacts and an edge of the substrate. The recess in the plug is provided in order to prevent a collision with the element.

An improvement of the invention provides that the substrate is part of a printed circuit board. For example, printed circuit tracks, which run on or in the substrate and connect at least one of the mating contacts to the component and/or a further component, can be provided.

An improvement of the invention provides that the element has an electrical connection to at least one of the mating contacts. A direct connection between the mating contact and the element is therefore provided. This is produced, for example, by means of a printed circuit track. It can also be provided that the electrical connection between element and mating contact is not made until the plug is in its plugged position, that is to say the contacts are electrically connected to the mating contacts. In doing so, the electrical connection between the element and the mating contact is made by the plug and its contacts respectively.

An improvement of the invention provides that the element is arranged in the region of the mating contacts. In this way, small signal propagation times between element and mating contact can be achieved. The arrangement of the element in the region of the mating contacts is provided particularly when there is an electrical connection between these elements. In the region of the mating contacts means that the element is arranged in particular directly thereon, adjacent thereto or at a small distance therefrom.

An improvement of the invention provides that the element is arranged between the mating contact and an edge of the substrate. This arrangement of the element is particularly advantageous, as in this way the space available on the substrate for elements can be as large as possible, but it is nevertheless guaranteed that the plug overlaps the substrate sufficiently to have a secure hold. The edge of the substrate can correspond to its perimeter.

An improvement of the invention provides that dimensions of the recess correspond substantially to those of the element. The recess is accordingly matched to the element. This can be provided both with regard to the dimensions and with regard to the shape of the recess. Advantageously, the latter corresponds substantially to an external contour of the component.

An improvement of the invention provides that, after fitting to the substrate, the plug encloses a mating contact region which contains the mating contacts. The mating contacts of the substrate are provided in the mating contact region. When the electrical connection between contacts and mating contacts is made, i.e. the plug is fitted to the substrate, then this must substantially enclose the mating contact region. This means that the plug protects the mating contact region against external influences. The plug therefore covers particularly the surface region of the mating contact region.

An improvement of the invention provides that the recess is closed after the plug has been fitted. This means that it is no longer accessible from the outside after the plug has been fitted. The element arranged in the recess is therefore additionally protected against external influences.

An improvement of the invention provides that the element is part of or forms a suppression unit. The element can therefore be the suppression unit or alternatively merely form a part thereof. The suppression unit is provided in order to improve an electromagnetic compatibility of the circuit provided on the substrate. The suppression unit therefore has a filter effect.

An improvement of the invention provides that the element is a capacitor and/or a suppression coil, in particular having a ferrite core. For example, the capacitor and/or the suppression coil is part of the suppression unit.

An improvement of the invention provides that at least one isolating recess which separates two of the mating contacts from one another is provided in the substrate. For example, a slot is therefore provided in the substrate which separates or isolates two of the mating contacts from one another. This isolation recess or slot is provided as a barrier against electrolysis or short circuit. For example, it prevents a film of moisture which forms on the substrate being able to make an electrical connection between two of the mating contacts. In this case, particularly advantageously, the mating contacts of the ground (GND) and plus potentials can be separated from one another by the isolating recess. At the same time, they can also be as far from one another as possible, wherein mating contacts of the signal potentials are provided between them, likewise separated by isolating recesses. The isolating recesses can, for example, be milled out of the substrate or already formed when the substrate is manufactured.

An improvement of the invention provides that the plug has a housing with at least one crosspiece which separates two contacts from one another. For example, the housing is a plug shroud. It has at least one crosspiece which is arranged between two of the contacts. The crosspiece separates the contacts from one another, in a similar way to that in which the isolating recess separates or isolates the mating contacts from one another. Accordingly, this also prevents a contact being made, by means of a film of moisture for example, between the two contacts on the plug side.

An improvement of the invention provides that the crosspiece is arranged corresponding to the isolation recess. This means that it is arranged in such a way that it engages in the isolating recess when and/or after the plug is fitted to the substrate. Advantageously, it substantially fills the isolating recess when the plug is in its plugged position, that is to say has reached its assembled position.

An improvement of the invention provides that, together with the housing, the crosspiece forms a plug chamber which has a seal. The seal is provided to seal the plug chamber with respect to an environment of the plug after the plug has been fitted, that is to say when and/or after the plugged position is reached. It is therefore intended to prevent foreign bodies and/or liquid entering the plug chamber in the plugged position of the plug and in this way adversely affecting the electrical connection between contact and mating contact. In particular, a dedicated plug chamber must be assigned to the contact when the signal transmitted on this contact is susceptible to interference. Advantageously, a dedicated plug chamber is also assigned to each of the ground and/or plus potentials.

BRIEF DESCRIPTION OF THE DRAWINGS

The invention is explained in more detail below with reference to the exemplary embodiments shown in the drawing without this limiting the scope of the invention. In the drawing.

DETAILED DESCRIPTION

Figure 1:
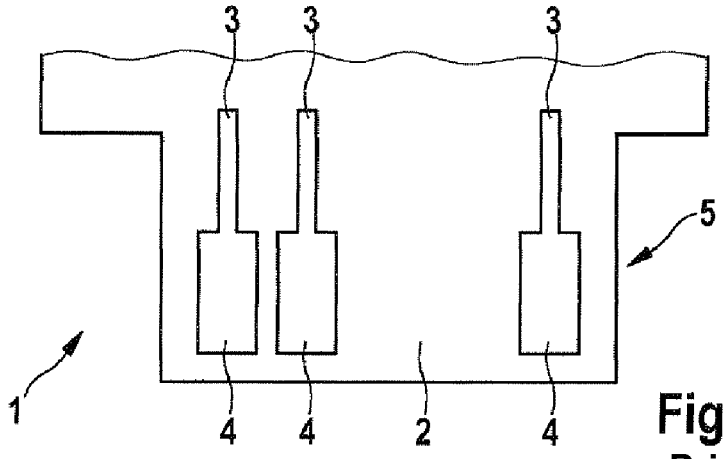
Fig. 1 Prior Art
FIG. 1 shows a substrate with mating contacts arranged thereon and printed circuit tracks.

FIGS. 1 to 5 illustrate the prior art. FIG. 1 shows a printed circuit board 1, which has printed circuit tracks 3 arranged on a substrate 2 and mating contacts 4. The mating contacts 4 are designed in the form of contact surfaces and occupy a substantially rectangular region on the substrate 2. The mating contacts 4 are also referred to as "lands". The mating contacts 4 are provided in a mating contact region 5 which forms a region of the printed circuit board 1.

Figure 2:
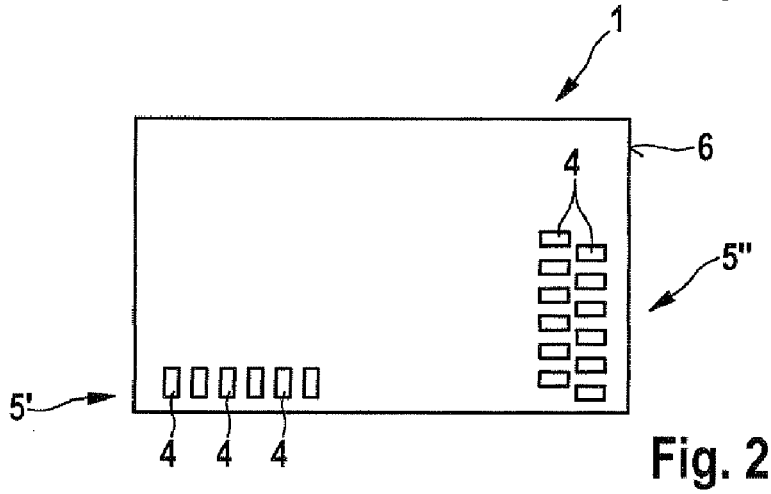
Fig. 2 Prior Art
FIG. 2 shows the substrate, wherein the mating contacts are provided in two mating contact regions, a single-row arrangement of mating contacts being provided in one of the mating contact regions and a multi-row arrangement in another of the mating contact regions.

FIG. 2 shows a further embodiment of the printed circuit board 1, wherein two mating contacts 5' and 5" are provided. Mating contacts 4 are arranged in a single row in the first mating contact region 5', and in multiple rows in the second mating contact region 5". This means that, in the latter case, the mating contacts 4 are arranged at different distances from an edge 6 of the substrate. In the case shown, the mating contacts 4 are offset with respect to one another.

Figure 3:
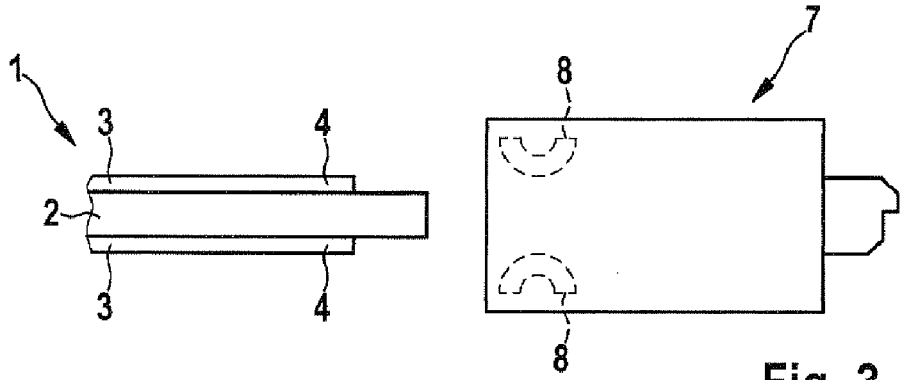
Fig. 3 Prior Art
FIG. 3 shows a schematic side view of the substrate and a plug.

FIG. 3 shows a schematic side view of the printed circuit board 1 with substrate 2 and printed circuit tracks 3 or mating contacts 4. Here, it can be seen that the printed circuit tracks 3 and the mating contacts 4 are provided on both sides of the substrate 2. As illustrated in FIG. 2, both a single and a multi-row, as well as a single or multi-sided arrangement of the mating contacts 4 are possible on the substrate 2. FIG. 3 also shows a plug 7 which contains a plurality of contacts 8. Here, preferably as many contacts 8 are provided in the plug 7 as mating contacts 4 on the substrate 2. However, a plug 7 with only one contact 8 or with a number of contacts 8 which differs from the number of mating contacts 4 is also possible.

The contacts 8 are electrically connected to a cable loom for example, which is not shown here. The plug 7 can be arranged in a plugged position on the substrate 2 in such a way that an electrical contact is made between the mating contacts 4 and the contacts 8. Electrical contact with the mating contacts 4 is therefore provided by means of the plug 7.

Figure 4:
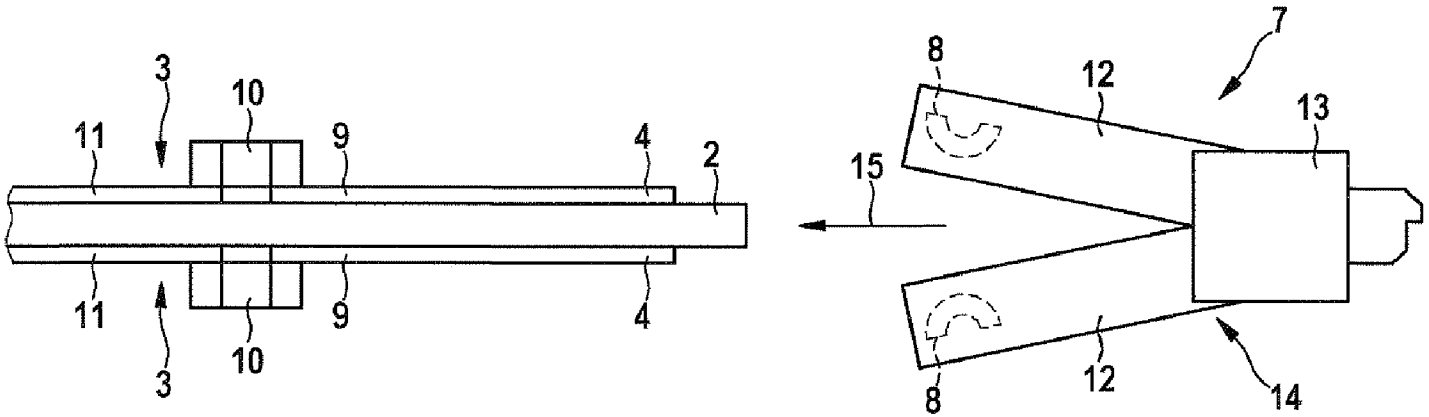
Fig. 4 Prior Art
FIG. 4 shows the substrate with an element arranged thereon and a further embodiment of the plug

FIG. 4 shows a further embodiment of the plug 7. On the substrate 2, it can be seen that a first printed circuit track region 9, which is connected to a second printed circuit track region 11 by means of an element 10, is connected to the mating contacts 4. Together, the printed circuit track regions 9 and 11 form the printed circuit track 3. The element 10 can be a capacitor or a suppression coil for example. At the same time, for example, it can be part of a suppression unit for improving the electromagnetic compatibility of a circuit (not shown) which is provided on the substrate 2 or the printed circuit board 1. In the example shown, the plug 7 has two contact carriers 12 in which the contacts 8 are arranged. In this case, the contact carriers 12 are arranged in a movable manner, for example so that they can swivel, with respect to one another. Together with a common housing part 13, they form a housing 14 of the plug 7. In the example shown, the contact carriers 12 are mounted on the housing part 13 so that they can swivel. At the same time, it is provided that the plug 7 can be fitted to the substrate 2 in an open position of the contact carriers 12 (as shown in FIG. 4). This is achieved by sliding the plug 7 in the direction of the arrow 15.

Figure 5:
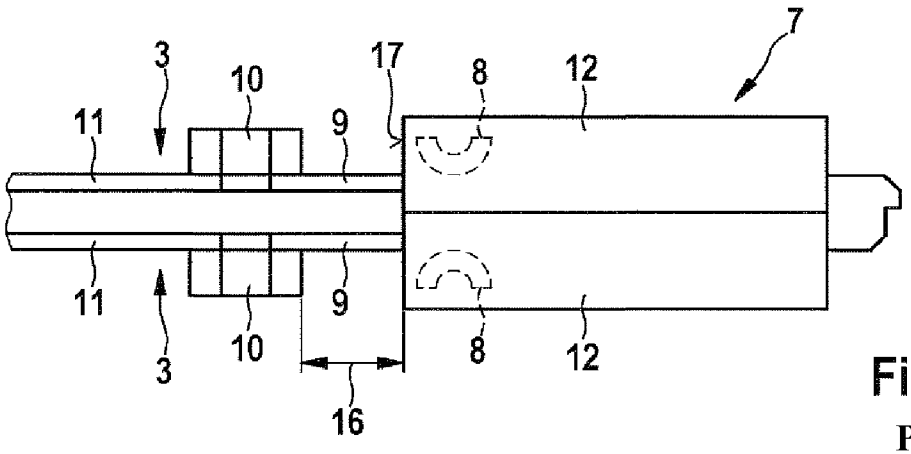
Fig. 5 Prior Art
FIG. 5 shows the substrate disclosed in FIG. 4 and the plug, wherein the latter is in its plugged position.

A swiveling of the contact carriers 12 into a closed position is then provided as is shown in FIG. 5. In this position, the plug 7 encloses a region of the substrate 2 in which the mating contacts 4 are provided. This region is the mating contact region 5 or 5' and 5" shown in FIGS. 1 and 2. In the closed position of the contact carriers 12 shown in FIG. 5, the plug 7 is in its plugged position, that is to say it is fitted to the substrate 2. In this state, there is an electrical contact between the contacts 8 and the mating contacts 4. The plug 7 is arranged so that it completely encloses or covers the mating contact region 5 and the mating contacts 4. The mating contacts 4, which lie in the region of the plug 7, are connected to the elements 10 by means of the printed circuit track 3 and the first printed circuit track region 9. Contact with the second printed circuit track region 11 is made by means of the element 10. There is therefore no direct connection between the first printed circuit track region 9 and the second printed circuit track region 11. In FIG. 5, a minimum distance between the element 10 and a front edge 17 of the plug 7 is shown by means of an arrow 16. This means that the printed circuit board 1 must be designed in such a way that the element 10 is arranged so that the minimum distance indicated by the arrow 16 is provided after the plug 7 is assembled.

Figure 6:
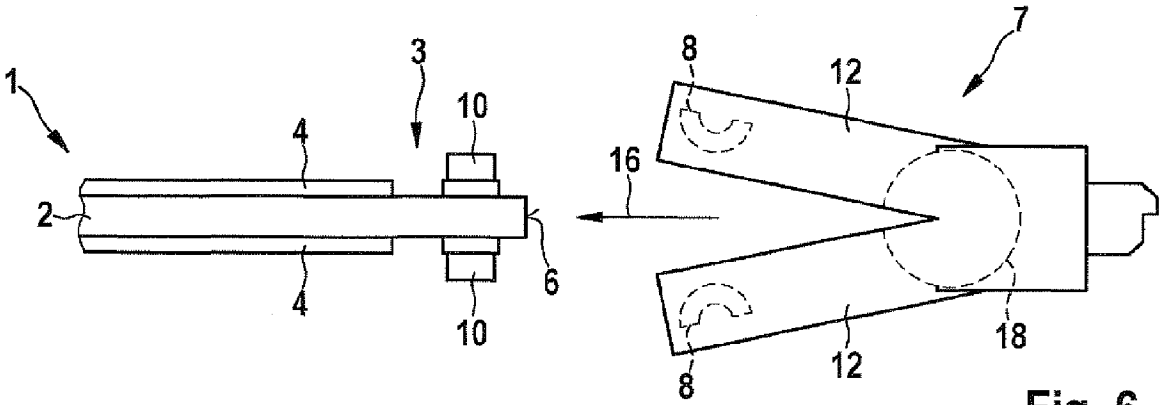
FIG. 6 shows the substrate, wherein the element is arranged between mating contacts and an edge of the substrate and the plug has a recess for accommodating the element.

In contrast, FIG. 6 shows a printed circuit board 1 and a plug 7 in which the elements 10 can be arranged closer to the edge 6 of the substrate 2. This is achieved by providing a recess 18 in the plug 7. The recess 18 is matched to the element 10 with regard to its dimensions and shape. In the example shown in FIG. 6, it is designed in such a way that it accommodates the element 10 or the elements 10 in the plugged position of the plug 7. A fitting of the plug 7 to the printed circuit board 1 as is disclosed in FIGS. 4 and 5 is provided in the direction of the arrow 16. The elements 10 are arranged on the printed circuit track 3 in such a way that an electrical connection (not visible here) is provided from the respective mating contact 4 to the element 10.

Figure 7:
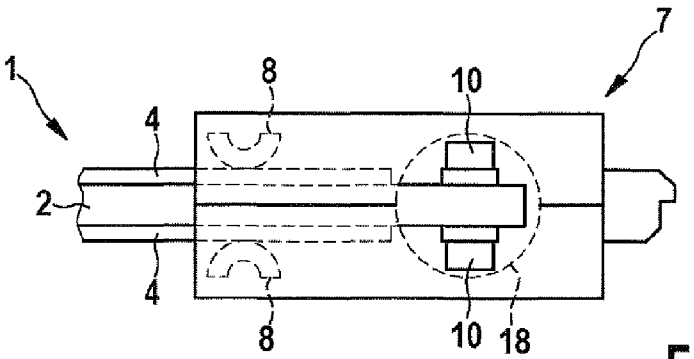
FIG. 7 shows the arrangement disclosed in FIG. 6, wherein the plug is in the plugged position.

In a similar way to FIG. 5, FIG. 7 shows the plugged position of the plug 7 on the printed circuit board 1. It can be seen how the contacts 8 of the plug 7 make electrical contact with the mating contacts 4 of the printed circuit board 1. At the same time, the elements 10 are arranged in the recess 18. This is shown schematically in FIG. 7. As already mentioned, an electrical connection is provided here between elements 10 and the respective mating contact 4.

Figure 8:
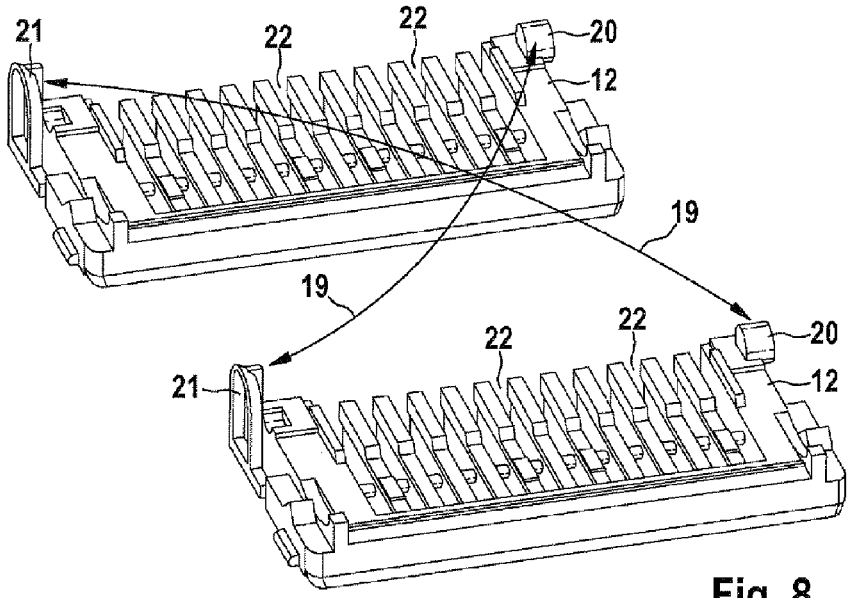
FIG. 8 shows two contact carriers of the plug with contacts arranged therein.

FIG. 8 shows the design of a plug 7. Initially, two identically designed contact carriers 12 are provided. In doing so, it is provided that, after rotating one of the contact carriers 12—as shown by the arrows 19—they can be fixed on top of one another. For this purpose, the contact carriers 12 have a bearing projection 20 on the one side and a bearing receptacle 21 on their other side. When the contact carriers 12 are assembled, a bearing projection 20 now engages in such a bearing receptacle 21 in each case. The contact carriers 12 are therefore fixed to one another so that they can swivel. Receiving slots 22 for the contacts 8 (not shown here) are provided in the contact carriers 12.

Figure 9:
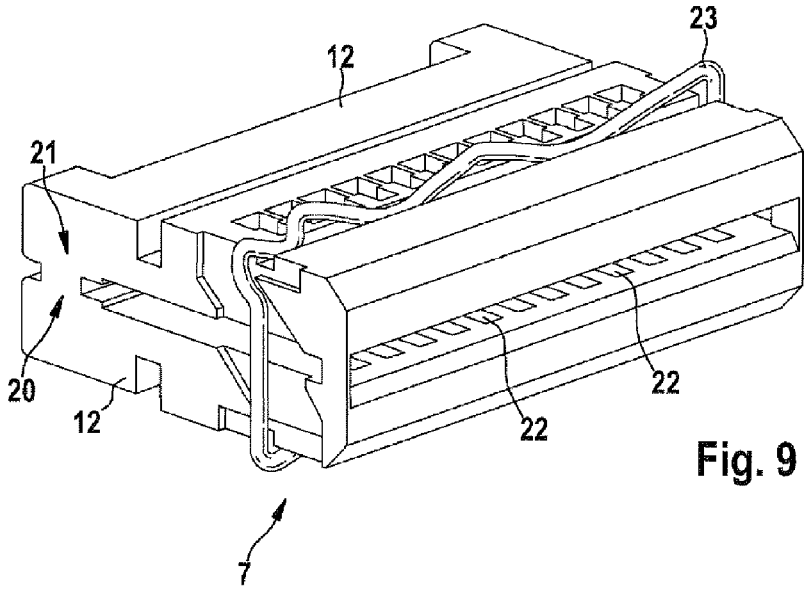
FIG. 9 shows the two contact carriers which are connected by means of a spring clip.

FIG. 9 shows the two contact carriers 12 in the assembled state, wherein they are fixed to one another by means of a spring clip 23. The spring clip 23 allows a spring-loaded swiveling of the contact carriers 12 about the bearing axis formed by bearing projection 20 and bearing receptacle 21 to a certain extent. In doing so, it is provided that this swiveling takes place when the plug 7 is pushed onto the printed circuit board 1 so that the plug 7 is retained and clamped by the spring action of the spring clip 23.

Figure 10:
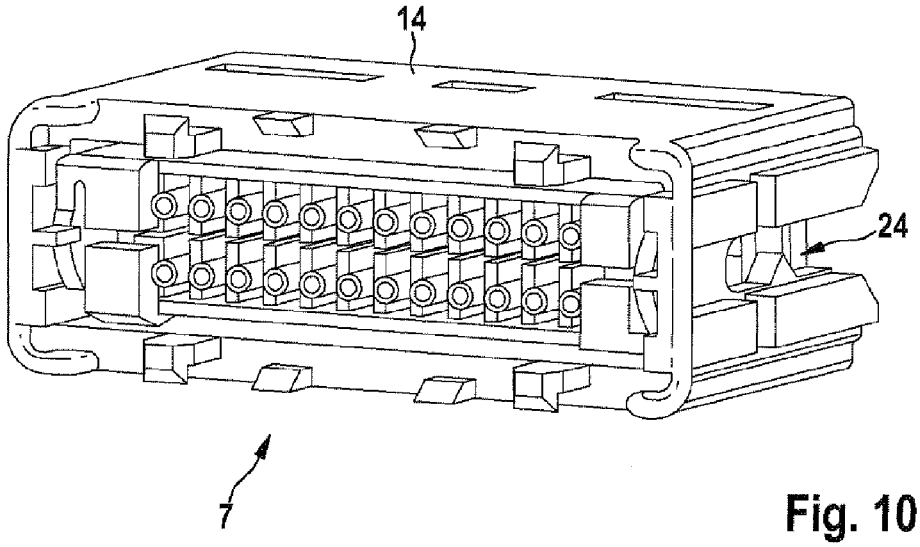
FIG. 10 shows the arrangement of contact carriers and spring clip which are arranged in a housing.
Figure 11:
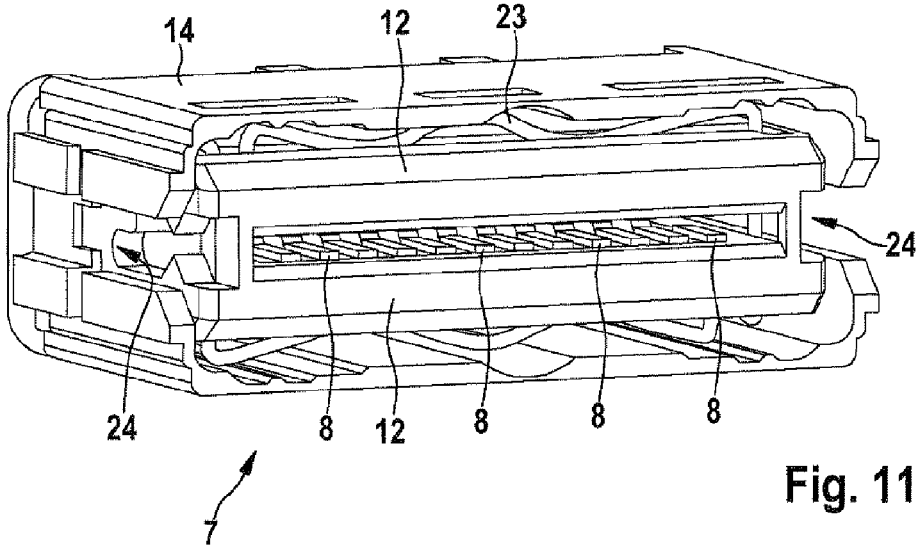
FIG. 11 shows a further view of the contact carriers with spring clip in the housing.

FIG. 10 shows how the two contact carriers 12 and the spring clip 23 are arranged together with the contacts 8 in the housing 14. In doing so, the housing 14 forms a so-called plug shroud. The housing 14 has lateral slots 24 in which the plug 7 is accommodated when it is fitted to the printed circuit board 1. The slot 24 therefore allows the plug 7 to be plugged onto the printed circuit board 1. While FIG. 10 shows the plug 7 viewed from the rear, in FIG. 11 it is shown in a front view. Here, it can be clearly seen how the contact carriers 12 are arranged in the housing 14 together with the spring clip 23. The contacts 8, which in each case are arranged in the receiving slots 22, and the slot 24 are also shown.

Figure 12:
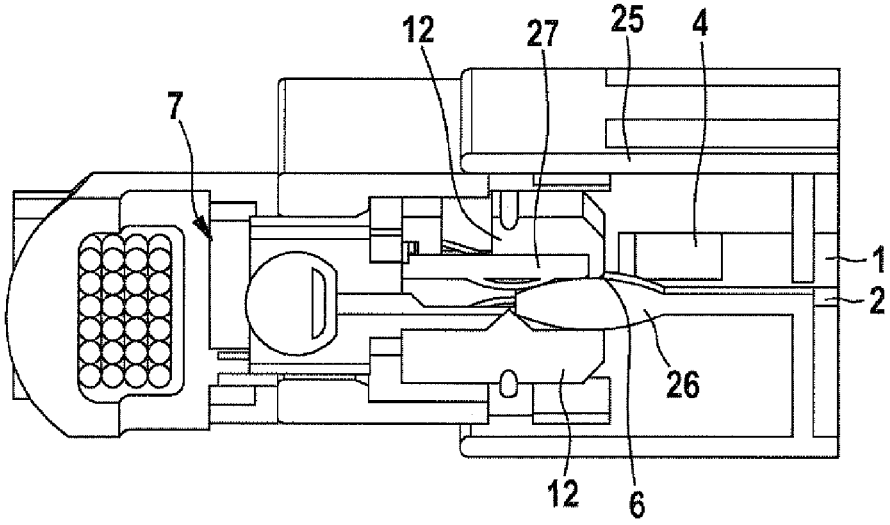
FIG. 12 shows the plug and the substrate before the plug is assembled.
Figure 13:
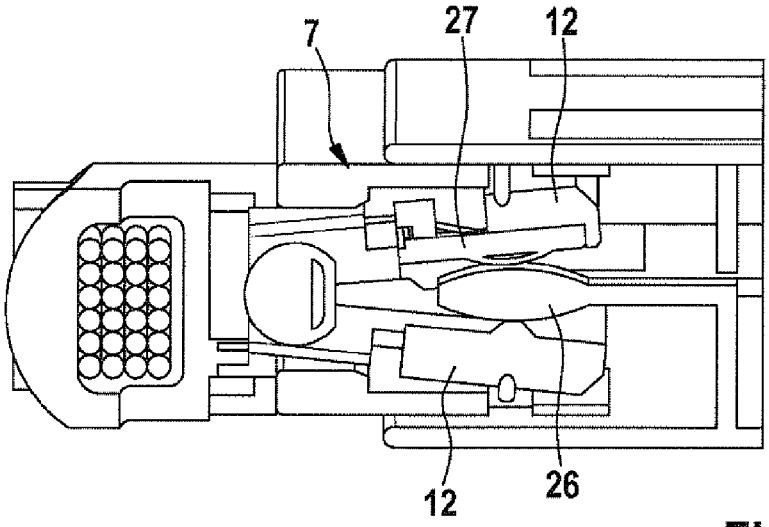
FIG. 13 shows the plug and the substrate during assembly of the plug.
Figure 14:
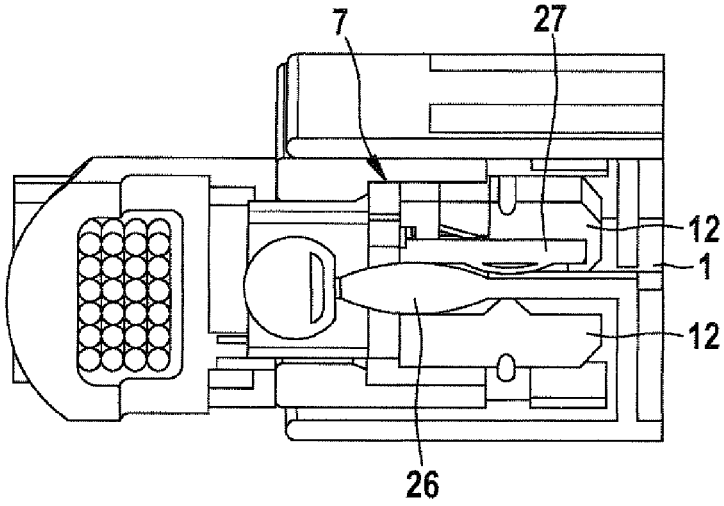
FIG. 14 shows the plug and the substrate after assembly, wherein the plug is in its plugged position.

FIGS. 12 to 14 show the process of assembling the plug 7 on the printed circuit board 1. The printed circuit board 1 is arranged in a printed circuit board housing 25 and fixed thereto. In the region of the printed circuit board 1, the printed circuit board housing 25 has a displacement element 26, which, for example, is substantially elliptical in cross section and at least in part has a greater height than the printed circuit board 1 or the substrate 2. When the plug 7 is plugged onto the printed circuit board 1, the displacement element 26 serves to swivel the contact carriers 12 in such a way that the contacts 8 of the plug 7 no longer come into contact with the edge 6 of the substrate 2. In doing so, the displacement element 26 can either act together with the contact carriers 12 or with a mating element 27 fixed thereto. In this way, the contacts 8 of the plug 7 can initially be guided past the edge 6 and subsequently come into electrical contact with the mating contacts 4 of the printed circuit board 1.

FIG. 13 shows how the plug 7 is partially pushed onto the printed circuit board 1. In doing so, the displacement element 26 works together with the mating element 27 in such a way that the contact carriers 12 are swiveled in opposite directions. The contacts 8—as described above—can therefore be guided past the edge 6.

FIG. 14 shows the plug 7 in its plugged position, i.e. after the plug 7 has been assembled on the printed circuit board 1. The mating element 27 has passed the displacement element 26 to such an extent that the contact carriers 12 are no longer swiveled in opposite directions. As a result, the contacts 8 provided in the contact carriers 12 come into electrical contact (not distinguishable in FIG. 14) with the mating contacts 4 of the printed circuit board 1.

Figure 15:
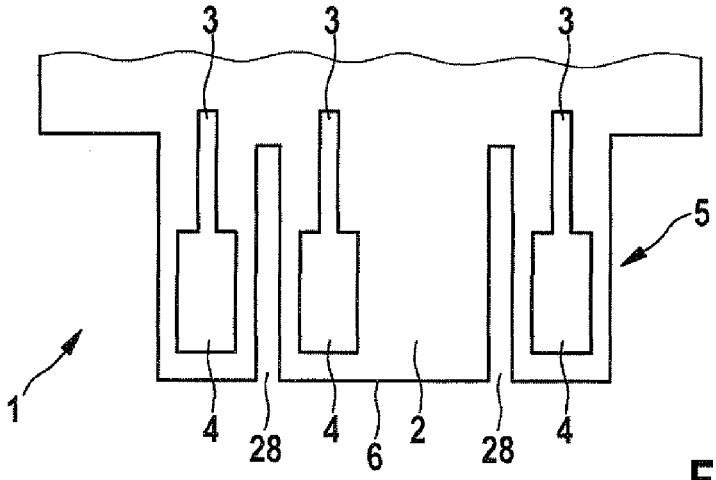
FIG. 15 shows the substrate, wherein recesses are provided between the mating contacts.

FIG. 15 shows a further embodiment of the printed circuit board 1, wherein isolation recesses 28 are provided between the mating contacts 4 and, in some places, possibly also between the printed circuit tracks 3. These are made in the substrate 2 in the form of slots and in particular are provided in the edge 6 of the printed circuit board 1 or the substrate 2. The isolation recesses 28 serve to separate the mating contacts 4 from one another, so that a film of liquid, for example, forming on the printed circuit board 1 cannot make an electrical connection between the mating contacts 4.

Figure 16:
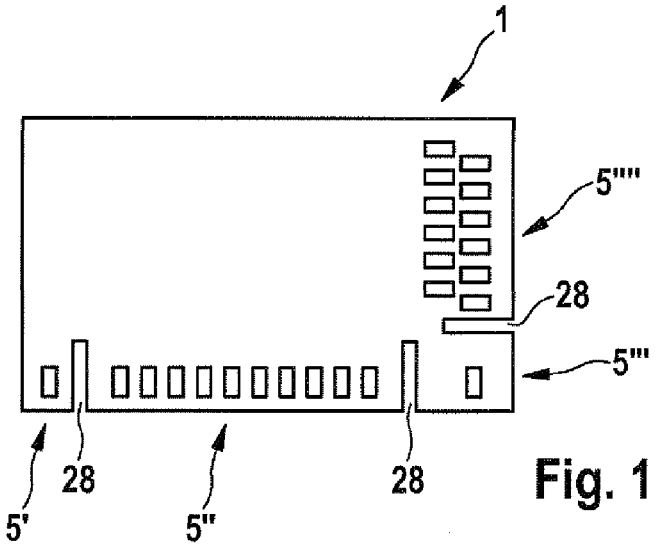
FIG. 16 shows a further embodiment of the substrate, wherein here too recesses have been made in the substrate between some of the mating contacts.

As shown in FIG. 16, a plurality of mating contact regions 5', 5", 5''', 5''' can each be separated from one another by isolating recesses 28.

Figure 17:
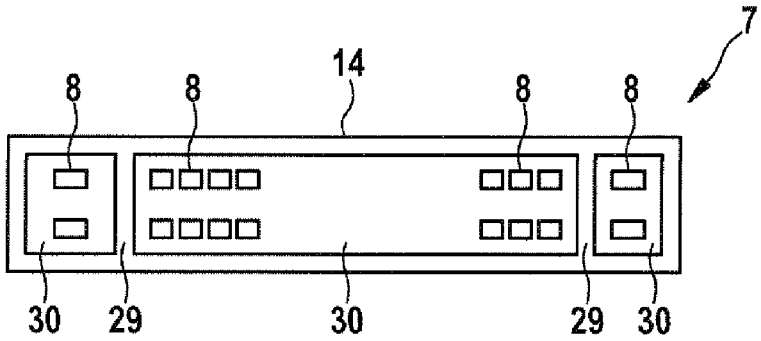
FIG. 17 shows a front view of a further embodiment of the plug, wherein the plug has crosspieces which, together with the housing, form plug chambers.

FIG. 17 shows the suitable plug 7 for the printed circuit board 1 designed according to FIGS. 15 and 16. Two crosspieces 29, which separate the contacts 8 or groups of contacts 8 from one another, are provided in the housing 14 thereof. The crosspieces 29 are arranged on the plug 7 in such a way that they engage in the isolating recesses 28 of the substrate 2 when the plug 7 is fitted to the printed circuit board 1. The crosspieces 29 are therefore arranged corresponding to the isolating recesses 28. The crosspieces 29 form three plug chambers 30 in the plug 7, wherein contacts 8 for the ground, plus and signal potentials for example are provided therein. The plug 7 can have a seal (not shown here) which, in the plugged position of the plug 7 on the printed circuit board 1, seals the plug chambers 30 against an environment of the plug 7. This prevents moisture and/or dirt penetrating the plug chambers 30 and, for example, causing a short circuit there between contacts 8 of the plug 7.

What is claimed is:

1. A plug connection device comprising a plug (7) which has two contact carriers (12) movable relative to one another, each contact carrier (12) including a contact (8), and further comprising a substrate (2) having mating contacts (4) arranged on the substrate (2) and an element (10) arranged on the substrate (2), wherein the contacts (8) on the plug (7) are provided for making electrical contact with the mating contacts (4) on the substrate (2), characterized in that the plug (7) has at least one recess (18) for accommodating the element (10).

2. The plug connection device as claimed in claim 1, characterized in that the substrate (2) is part of a printed circuit board (1).

3. The plug connection device as claimed in claim 1, characterized in that the element (10) has an electrical connection to at least one of the mating contacts (4).

4. The plug connection device as claimed in claim 1, characterized in that the element (10) is arranged in a region of the mating contacts (4).

5. The plug connection device as claimed in claim 1, characterized in that the element (10) is arranged between the mating contacts (4) and an edge (6) of the substrate (2).

6. The plug connection device as claimed in claim 1, characterized in that dimensions of the recess (18) correspond substantially to dimensions of the element (10).

7. The plug connection device as claimed in claim 1, characterized in that, after fitting to the substrate (2), the plug (7) encloses a mating contact region (5) which contains the mating contacts (4).

8. The plug connection device as claimed in claim 1, characterized in that the recess (18) is closed after the plug (7) has been fitted to the substrate (2).

9. The plug connection device as claimed in claim 1, characterized in that the element (10) is at least part of a suppression unit.

10. The plug connection device as claimed in claim 1, characterized in that the element (10) is at least one of a capacitor and a suppression coil.

11. The plug connection device as claimed in claim 1, characterized in that at least one isolating recess (28), which separates two of the mating contacts (4) from one another, is provided in the substrate (2).

12. The plug connection device as claimed in claim 1, characterized in that the plug (7) has a housing (14) with at least one crosspiece (29), which separates two of the contacts (8) on the plug (7) from one another.

13. A plug connection device comprising a plug (7) which has contacts (8), and further comprising a substrate (2) having mating contacts (4) arranged on the substrate (2) and an element (10) arranged on the substrate (2), wherein the contacts (8) on the plug (7) are provided for making electrical contact with the mating contacts (4) on the substrate (2), and wherein the plug (7) has at least one recess (18) for accommodating the element (10), characterized in that the plug (7) has a housing (14) with at least one crosspiece (29), which separates two of the contacts (8) on the plug (7) from one another, and further characterized in that at least one isolating recess (28), which separates two of the mating contacts (4) from one another, is provided in the substrate (2), and the crosspiece (29) is arranged corresponding to the isolating recess (28).

14. The plug connection device as claimed in claim 12, characterized in that, together with the housing (14), the crosspiece (29) forms a plug chamber (30) which has a seal.

* * * * *